United States Patent [19]

Cryder et al.

[11] 4,165,675

[45] Aug. 28, 1979

[54] LOAD CHECK VALVE CYLINDER MOUNTED

[75] Inventors: John R. Cryder, Joliet; Lowell R. Hall, Elwood, both of Ill.

[73] Assignee: Caterpillar Tractor Co., Peoria, Ill.

[21] Appl. No.: 785,629

[22] Filed: Apr. 7, 1977

[51] Int. Cl.[2] ..... F15B 11/08; F15B 13/042

[52] U.S. Cl. ..... 91/420; 91/445; 91/447; 91/451; 91/452; 91/464

[58] Field of Search ..... 91/445, 447, 420, 464, 91/451, 452; 137/596.2

[56] References Cited

U.S. PATENT DOCUMENTS

| | | | |
|---|---|---|---|
| 3,049,101 | 8/1962 | Ruhl | 91/447 X |
| 3,127,688 | 4/1964 | Hein et al. | 91/445 X |
| 3,216,448 | 11/1965 | Stacey | 137/636.1 X |
| 3,274,902 | 4/1966 | Kleckner | 137/596.2 X |
| 3,523,490 | 8/1970 | Bianchetta | 91/420 |
| 3,788,401 | 1/1974 | Scheidt et al. | 91/445 X |
| 3,795,255 | 3/1974 | Malott et al. | 91/420 X |
| 3,800,670 | 4/1974 | Hufeld et al. | 91/420 |
| 3,908,515 | 9/1975 | Johnson | 91/445 X |
| 4,006,667 | 2/1977 | Biachetta et al. | 91/445 |
| 4,018,350 | 4/1977 | Brown | 91/447 X |

*Primary Examiner*—Irwin C. Cohen

*Attorney, Agent, or Firm*—Phillips, Moore, Weissenberger, Lempio & Majestic

[57] ABSTRACT

A hydraulic motor and control system which comprises a pump delivering fluid to a control valve. The control valve has a Float position which connects a first end of the motor to sump, a First position for applying fluid from the pump to power the motor in a first direction by delivering fluid to the motor's first end via a flow path and a Second position in which the motor moves in a second and opposite direction. A conduit connects the control valve to the sump. A check valve is provided in the flow path which always allows flow therethrough towards the motor's first end and normally blocks reverse flow therethrough. A mechanism opens the check valve to permit reverse flow therethrough responsive to operation of the control valve in the Float position and in the Second position.

8 Claims, 2 Drawing Figures

LOAD CHECK VALVE CYLINDER MOUNTED

BACKGROUND OF THE INVENTION

1. Field of the Invention

The invention is concerned with controlling a hydraulic motor which raises and lowers relatively heavy loads. Particularly, the invention is concerned with such a system which includes a safety feature wherein if any of the hydraulic lines of the system fail while the load is in a raised position, the load is prevented from falling at a very fast rate by particularly improved check valve means arranged in the end of the hydraulic motor. Still more particularly, the invention is concerned with a hydraulic motor control system as discussed above which provides a Float position of operation wherein both the head end and rod end of the motor communicate with drain at the same time. Such a Float position is particularly useful with front loading loaders so that as a bucket thereof is pushed across uneven ground the bucket will raise and lower with the contour of the ground. A Float position is likewise desirable for the same reason with dozers. While the improvement of the present invention is particularly useful with front loading loaders and dozers it should be noted that it is also useful with a number of other apparatus, for example tractors, scrappers, lift-trucks and the like.

2. Prior Art

Fluid-driven motors are usually controlled with a directional control valve wherein a spool or other valve member is shiftable between a Neutral (or Hold) position at which the motor is stopped, another position, e.g., a Raise position for operating the motor in a first direction, and yet another position, e.g., a Lower position, for reversing operation of the motor. In many instances, the motor moves a load which may occasionally tend to move faster than at the rate which is provided for by the rate at which fluid is supplied to the motor in the directional control valve.

For example, power loaders as are used to handle loose earth or other bulk material have a bucket carried on a pair of pivoting lift-arms at the front of the vehicle where an upward and downward movement of the bucket is typically provided for by fluid motors controlled by the vehicle operator. When the loaded bucket is being lowered, gravitational force may tend to drive the fluid motors faster than is provided for by the supply of driving fluid. Under this condition, motor cavitation will occur, with well-known undesirable effects, unless corrective means are provided. One such means of preventing cavitation are makeup valves which sense incipient cavitation and open to supplement the driving fluid to the motor with fluid which is being discharged from the motor.

Providing of a Float position in the control system may also be useful. For example, a loader as discussed above is often used to pick up loose material by pushing the bucket along the surface of the ground to receive such material. On an uneven terrain, it is desirable that the bucket follow the contour of the ground and a Float position of the control system enables the bucket to do this.

A quite serious problem can arise if the hydraulic lines leading from the pump to the fluid driven motors should break. In such a case, when heavy loads are in the Raise position these loads would then tend to fall very rapidly, thus potentially causing significant damage to the apparatus as well as to the load itself. Thus, it is quite desirable for safety considerations to provide some means for checking the rate of fall of a load from the Raise position in the event of line failure. However, any such solution must at the same time allow for the providing of the aforementioned Float position with its appropriate connections as well as for operator controlled lowering of the load, i.e., a Lower position. It should also be noted that it is highly desirable that if the hydraulic lines to the hydraulic motor should break then the means which provides a reduced lowering rate is still operative.

SUMMARY OF THE INVENTION

The present invention is directed to overcoming one or more of the problems as set forth above.

The invention is concerned with an improvement in a hydraulic motor and control system therefor which has fluid source means for delivering fluid from sump means via first conduit means to control valve means having a float position wherein a first end of the motor is in flow communication with the second end thereof and with the sump means, a first position for applying fluid from the fluid source means to power the motor to move in a first direction by delivering the fluid to the first end of the motor via second conduit means, and a second position in which the motor moves in a second direction; third conduit means communicating a second end of the motor with the control valve means, the control valve means providing interconnection of the first, second and third conduit means with a sump conduit means in the float position, the third conduit means communicating via the control valve means in the first position with the sump conduit means and the first conduit means communicating thereby with the second conduit means in the first position via the control valve means, the control valve means providing a second position in which the second conduit means communicates thereby with the sump conduit means and the first conduit means communicates thereby with the third conduit means; the sump conduit means communicating the control valve means with the sump means. The improvement of the invention comprises check valve means in the second conduit means allowing fluid flow therethrough to the first end of the motor and normally blocking fluid flow therethrough from the first end of the motor to the control valve means. The improvement also includes hydraulically actuated means for opening the check valve means to allow fluid flow therethrough from the first end of the motor to the control valve means responsive to operation of the control valve means in the second position, the hydraulically actuated opening means having a pilot operated check valve; means biasing the pilot operated check valve to be closed; pilot conduit means communicating the third conduit means with the pilot operated check valve to provide fluid pressure from the fluid source means in opposition to the biasing means; drain conduit means communicating the first end of the hydraulic motor with the pilot operated check valve; pilot sump conduit means communicating the pilot operated check valve, when open, with the sump means; flow conduit means communicating the drain conduit means to the control valve means; and drain path means in the control valve means which communicates the flow conduit means to the sump means when the control valve means is in the float position. The improvement further includes having the drain path means within the control valve means for providing connection between the first conduit means and the second conduit means responsive to the control valve means being in the first position and between the first conduit means and the third conduit means responsive to the control valve means being in the second position, while blocking the communication of the flow conduit means with the sump means.

BRIEF DESCRIPTION OF THE DRAWING

The invention will better understood by reference to the figures of the drawings wherein.

DETAILED DESCRIPTION OF THE PREFERRED EMBODIMENT

Figure 1:
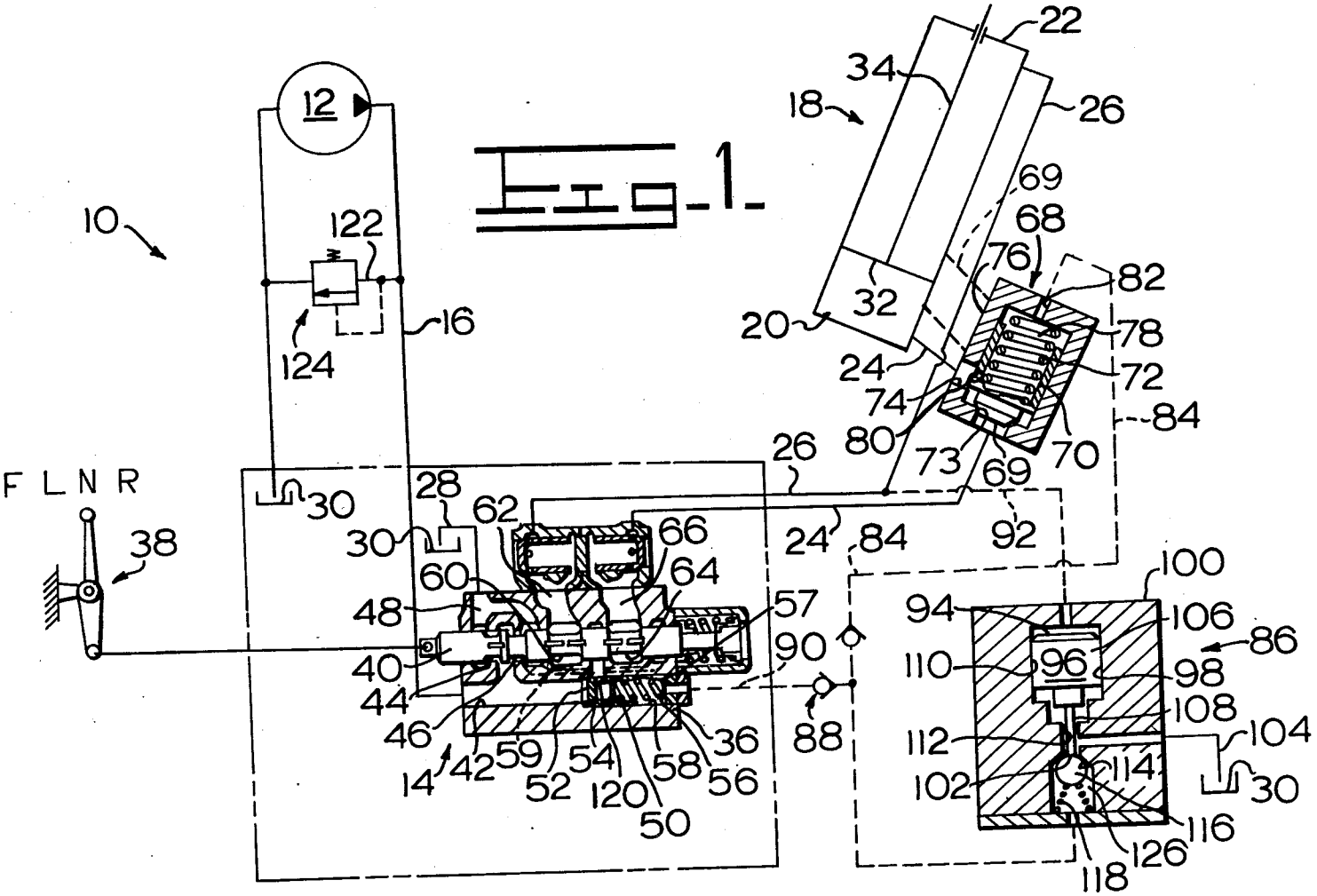
FIG. 1 illustrates a hydraulic fluid control system in accordance with the present invention, partially schematically and partially in section.
Figure 2:
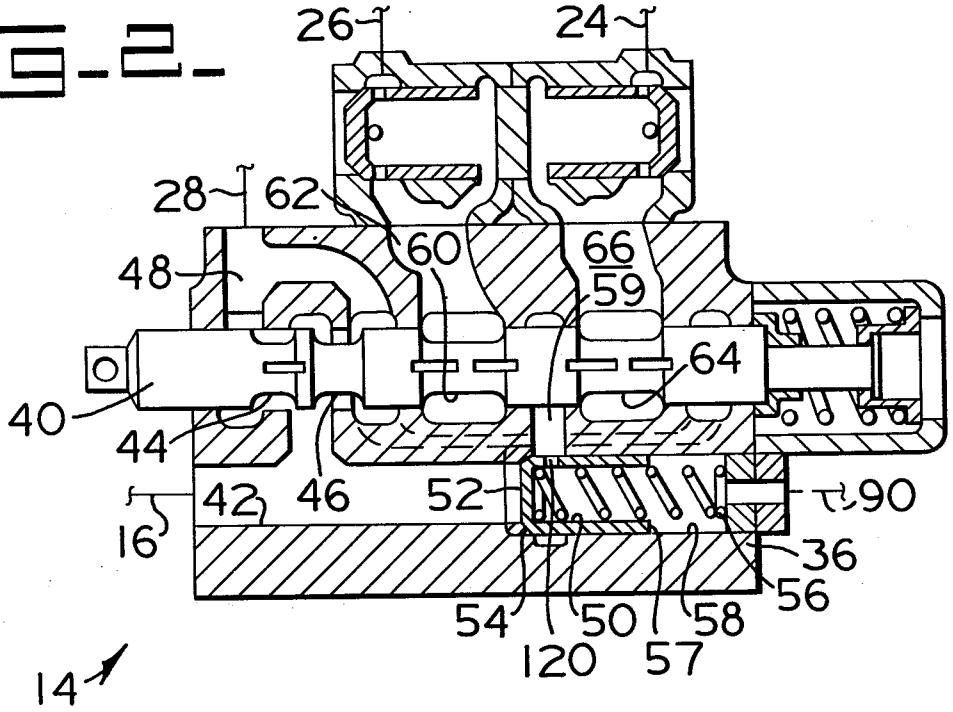
FIG. 2 illustrates on a larger scale, a portion of the system shown in FIg. 1.

While the following description is directed particularly to a system which includes a hydraulic motor arranged to raise and lower loads it is to be understood that the present invention equally relates to horizontal motors and that, hence, the terms Raise and Lower as used herein are merely illustrative of the broader terms "power in a first direction" and "power in a second direction", respectively. Also, while the following description is of a double acting motor the system described is equally applicable to single acting motors as, for example, lift truck mast extension cylinders and the like.

Referring now to the sole figure of the drawing, there is illustrated therein a hydraulic motor control system 10 which comprises fluid source means, in the embodiment illustrated a pump 12, control valve means, in the embodiment illustrated a conventional control valve 14, a first conduit 16, which communicates an outlet fluid flow from the pump 12 with the control valve 14, a hydraulic motor 18, having a first or head end 20 and a second or rod end 22, a second conduit 24 which communicates the control valve 14 with the first end 20 of the hydraulic motor 18, a third conduit 26 which communicates the control valve 14 with the second end 22 of the hydraulic motor 18 and a fourth or sump conduit 28 which communicates the control valve 14 with a sump 30. When it is stated that the second conduit 24 and the third conduit 26 communicate the control valve 14 with the first end 20 and second end 22 of the hydraulic motor 18, it is of course, understood that the communication is with a chamber within the hydraulic motor 18 whereby a pressure differential can be exerted across a piston 32 within the hydraulic motor 18, to thus move the piston 32 and the attached rod 34.

The present invention is particularly concerned with using a control valve 14 which is formed generally within a control valve body 36. The particular control valve 14 provides a Neutral position in which the second conduit 24 and the third conduit 26 are isolated by the control valve 14 from the sump 30 and wherein the first conduit 16 communicates via the control valve 14 with the sump 30. The figure of the drawing specifically illustrates the control valve 14 in such a Neutral position. A control linkage 38 which communicates with a spool 40 of the control valve 14, motivates the control valve 14 to be shifted from the Neutral position into a Raise position, a Lower position and a Float position. In the Float position the first conduit 16, the second conduit 24 and the third conduit 26 communicate via the control valve 14 with the sump conduit 28. In the Raise position, the third conduit 26 communicates via the control valve 14, with the sump conduit 28 and the first conduit 16, communicates via the control valve 14 with the second conduit 24. In the Lower position the second conduit 24 communicates via the control valve 14 with the sump conduit 28 and the first conduit 16 communicates via the control valve 14 with the third conduit 26.

Considering the Neutral position as illustrated in the drawing, fluid flow from the pump 12 is introduced via the first conduit 16 to a first bore 42 within the control valve body 36. The fluid then passes about the spool 40 via a first undercut 44 and a second undercut 46 in the spool 40, thence to a chamber 48, to the sump conduit 28 and therefrom to the sump 30. Thus, it is clear that in the Neutral position no pressure can build up within the first bore 42.

If the control lever 38 is shifted to the Lower position, the spool 40 moves rightwardly sufficiently so as to block passage from the first bore 42 into the chamber 48 thus building up pressure within the first bore 42. Pressure within the first bore 42 forces a sleeve 50, which is closed at one end 52 thereof away from a seat 54 against the biasing of a spring 56. A second end 57 of the sleeve 50 is open. The sleeve 50 then slides rightwardly within a drain bore 58 which is generally within the control valve body 36. As the sleeve 50 slides rightwardly flow communication is established between the first bore 42 and a passage 59 and thence about a third undercut 60 in the spool 40, into a first flow chamber 62 and thence via the third conduit 26 to the second end 22 of the hydraulic motor 18. Drainage of the first end 20 of the hydraulic motor 18 occurs in a manner which will be explained below.

When the control lever 38 is thrown to the Raise position, similar build up of pressure takes place within the first bore 42, thus moving the sleeve 50 and providing flow into the passage 59. In this case, however, flow from the passage 59 proceeds via a fourth undercut 64 in the spool 40 into a second flow chamber 66 and thence to a second conduit 24 to the first end 20 of the hydraulic motor 18. Meanwhile, drainage from the second end 22 of the hydraulic motor 18 occurs via the third conduit 26, thence to the first flow chamber 62, about the third undercut 60, to the chamber 48 and thence to the sump 30 via the sump conduit 28.

In the Float position the pump 12 communicates with the sump 30 via the first bore 42, the first undercut 44 and the chamber 48. Meanwhile, the second end 22 of the hydraulic motor 18 communicates with the sump 30 via the first flow chamber 62 and the second undercut 46. The first end 20 of the hydraulic motor 18 also communicates with the sump 30 in a manner which will be explained below.

Coming now to the attainment of a safety feature whereby in the case of breakage of the first conduit 16 any load held in a raised position can be lowered at a reduced rate, it is noted that this is provided by check valve means, in the embodiment illustrated a check valve 68 in the second conduit 24 intermediate the control valve 14 and the first end 20 of the hydraulic motor 18. The check valve 68 is preferably mounted to the hydraulic motor 18 by conventional means, e.g., bolts and nuts, as indicated schematically by dashed lines 69 to reduce any chance of damage to the second conduit 24. It is clear that flow can occur through the check valve 68 when the control valve 14 is in the Raise position since pressure is exerted against a closed first end 69 of a spool 70 (in the form of a sleeve-piston) to overcome the biasing of a spring 72 which normally holds the sleeve-piston 70 against a seat 73 whereby pressurized fluid flows up about the spool 70 and thence through a hole 74 in a wall 76 of the check valve 68. The fluid which flows through the hole 74 then proceeds via a continuation of the second conduit 24 to the first end 20 of the hydraulic motor 18 and more particularly, to a chamber wherein the pressure of the hydraulic fluid is exerted against the piston 32 to force the piston 32 and the rod 34 therewith upwardly.

When the flow is to pass out of the first end 20 of the hydraulic motor 18 and back through the control valve 14 to the sump 30, the flow passes through the hole 74 in the wall 76 of the check valve 68 and thence a pilot flow proceeds to and through a check valve chamber 78 via a small restricted orifice 80 to provide a pressure differential which unseats the sleeve-piston 70 from the seat 73 by overcoming the biasing of the spring 72. The pilot flow proceeds from the chamber 78 through a second hole 82 in the check valve 68 and thence via a fifth or drain conduit 84 to either a pilot operated check valve 86 as in the Lower position of operation or via an in-line check valve 88 and a flow conduit 90 and into the passage 58 from which it can exit in the Float position of operation.

With the control valve 14 in the Lower position pressure from the third conduit 26 is applied via a pilot conduit 92 to a first end 94 of a pilot piston 96 which slidingly fits within a pilot bore 98 in a pilot valve body 100. The pilot conduit 92 applies fluid pressure from the third conduit 26 against the first end 94 of the pilot piston 96 whilst the drain conduit 84 applies fluid pressure therefrom against a ball and thus against a second area at a second end 102 of the pilot piston 96. A ratio of the first area, the area of the first end 94, to the second area, the area of the second end 102, is generally at least about 5:1 and more often greater than 15:1 to ensure that the relatively high pressure in the first end 20 of the hydraulic motor 18 can be vented with only a relatively low pressure being applied from the second end 22 of the hydraulic motor 18 via the pilot conduit 92 to the first end 94 of the pilot piston 96. A sixth or pilot sump conduit 104 is provided which communicates the pilot operated check valve 86, when open, with the sump 30.

In the particular embodiment illustrated, the pilot piston 96 comprises a first portion 106 and a second portion 108. The first portion generally has a first cross sectional area generally equal to the first area of the first end 94 of the pilot piston 96 and terminates intermediate the first end 94 and the second end 102 of the pilot piston 96. The pilot piston 96 further has a second portion 108 thereof of a second cross sectional area which is generally equal to the second area at the second end 102 of the pilot piston 96. The second portion 108 of the pilot piston 96 terminates intermediate the first end 94 and the second end 102 thereof. The pilot bore 98 comprises a first bore portion 110 in which the first piston portion 106 reciprocally fits in sliding touching relation and a second bore portion 112 in which the second piston portion 108 reciprocally fit in spaced apart relation thereto. A pilot seat 114 is in the pilot valve body 100 adjacent the second end 102 of the pilot piston 96. A member 116, in the embodiment illustrated a ball, is biased by a spring 118 to sit against the pilot seat 114 and shut off the second bore portion 112 from contact with fluid which flows through the drain conduit 84 unless and until sufficient pressure is applied via the pilot conduit 92 to move the pilot piston 96 downwardly, thus unseating the member 116 and allowing flow therearound and thence through the pilot sump conduit 104 which communicates with the second bore portion 112. It is clear then that when the control linkage 38 is thrown into the Lower position, the pilot flow from the first end 20 of the hydraulic motor 18, which serves to open the check valve 68 to reverse flow, occurs via the drain conduit 84, about the member 116 and thence via the pilot sump conduit 104.

In the Float position the aforementioned and described path for pilot flow to the sump 30 from the first end 20 of the hydraulic motor 18 does not operate because no pressure is applied to the third conduit 26 and hence no pressure is applied to the pilot conduit 92 and the member 116 blocks this flow path. In the Float position, pilot flow from the drain conduit 84 which originates in the first end 20 of the hydraulic motor 18 passes via the in-line check valve 88 to the passage 58 in the control valve body 36. Since in the Float position the output of the pump 12 is being directed to the sump 30, the first bore 42 is not pressurized, thus, the sleeve 50 is in its leftwardmost position under the impetus of the spring 56. Fluid which passes the in-line check valve 88 and flows through the float conduit 90 is introduced directly into the passage 58 and flows therefrom via a cross passage 120, thence to the passage 59, about the third undercut 60, to the first flow chamber 62, thence to the second undercut 46, the chamber 48 and the fourth conduit 28 to the sump 30. It is clear that in the Float position the pilot flow from the first end 20, the main outflow from the first end 20 and the outflow from the second end 22 of the hydraulic motor 18, each communicate to the sump 30 via the second flow chamber 66.

The in-line check valve 88 serves an important purpose in that any pressure which might be built up in the passage 58 is prevented from flowing in a reverse direction through the drain conduit 84 thereby. Thus, leakage from the passage 58 and through the cross passage 120 cannot cause any serious problems.

The pump 12 preferably includes a seventh conduit 122 which communicates the first conduit 16 via a pressure relief valve 124 to the sump 30 when the control valve 14 is in the Raise position or in the Lower position. This provides a control on the pressure developed by the pump 12 and allows relief thereof when the pump 12 is not connected otherwise to the sump 30.

What results from the above set-out structures and their equivalents is a control system for a hydraulic motor which has Float, Lower, and Raise positions or modes of operation, which further provides a safety feature whereby a load which has been raised will not fall under the full force of gravity in an uncushioned manner if the first conduit 16 is breached and which further allows the load to be lowered via the path set out with respect to the Float position operation. It should further be noted that the check valve 68, the pilot operated check valve 86 and the in-line check valve 88 can be relatively small in size and can, if desired, be mounted directly on to the hydraulic motor 18 whereby the continuation of the second conduit 24 between the hole 74 in the check valve 68 and the first end 20 of the hydraulic motor 18 can be extremely short as by abutting the check valve 68 against a side of the hydraulic motor 18, thus preventing any serious problem of rupture of the second conduit 24 between the check valve 68 and the hydraulic motor 18. Further, the pilot operated check valve 86 can be stacked directly upon the check valve 68 whereby the second hole 82 in the check valve 68 communicates directly with a pilot chamber 126, thus again reducing the possibility for breakage of hydraulic lines. In such a construction the in-line check valve 88 and the float conduit 90 can communicate with the second hole 82 and the pilot chamber 126 as via a cross bore or other equivalent means.

While the invention has been described in connection with specific embodiments thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

The embodiments of the invention in which an exclusive property or privilege is claimed are defined as follows:

1. In a hydraulic motor and control system therefor which comprises fluid source means for delivering fluid from sump means via first conduit means to control valve means having a float position wherein a first end of said motor is in flow communication with a second end thereof and with said sump means, a first position for applying fluid from said fluid source means to power said motor to move in a first direction by delivering said fluid to said first end thereof via second conduit means, and a second position in which said motor moves in a second direction; and sump conduit means communicating said control valve means with said sump means; an improvement comprising:

check valve means in said second conduit means allowing fluid flow therethrough to said first end of said motor and normally blocking fluid flow therethrough from said first end of said control valve means;

hydraulically actuated opening means for opening said check valve means to allow fluid flow therethrough from said first end of said motor to said control valve means responsive to operation of said control valve means in said second position;

third conduit means communicating a second end of said motor with said valve means;

wherein said control valve means provides as said float position a mode in which said first, second and third conduit means communicate thereby with said sump conduit means, as said first position a mode in which said third conduit means communicate thereby with said sump conduit means and said first conduit means communicates thereby with said second conduit means and as said second position a mode in which said second conduit means communicates thereby with said sump conduit means and said first conduit means communciates thereby with said third conduit means;

wherein said hydraulically actuated opening means comprises a pilot operated check valve; means biasing said pilot operated check valve to be closed; pilot conduit means communicating said third conduit means with said pilot operated check valve to provide fluid pressure from said fluid source means in opposition to said biasing means; drain conduit means communicating said first end of said hydraulic motor with said pilot operated check valve; pilot sump conduit means communicating said pilot operated check valve, when open, with said sump means; float conduit means communicating said drain conduit means to said control valve; an in-line check valve in said float conduit means which allows fluid flow towards said control valve means and prevents fluid flow away therefrom; and drain path means in said control valve means which communicates said float conduit means to said sump means when said control valve means is in said float position;

pressure relief means communicating said first conduit means to said sump means when said control valve means is in said first and second positions; and wherein said drain path means comprises a sleeve which is closed at one end thereof within a drain bore in said control valve means biased so that said closed end sits against a drain seat formed in said control valve means, an open end of said sleeve being in flow communication with said float conduit means, said drain seat being in flow communication with said first conduit means, said sleeve including passage means therethrough to said sump means in said float position, said passage means closing when said sleeve moves away from said seat, movement of said sleeve away from said seat being caused by pressure build up against said closed end thereof overcoming said biasing thereof in said first and second positions to provide connection between said first conduit means and said second and third conduit means, respectively.

2. In a hydraulic motor and control system therefor which comprises fluid source means for delivering fluid from sump means via first conduit means to control valve means having a float position wherein a first end of said motor is in flow communication with a second end thereof and with said sump means, a first position for applying fluid from said fluid source means to power said motor to move in a first direction by delivering said fluid to said first end thereof via second conduit means, and a second position in which said motor moves in a second direction; third conduit means communicating a second end of said motor with said control valve means, said control valve means providing interconnection of said first, second and third conduit means with said sump conduit means in said float position, said third conduit means communicating via said control valve means in said first position with said sump conduit means and said first conduit means communicating thereby with said second conduit means in said first position via said control valve means, said control valve means providing a second position in which said second conduit means communicates thereby with said sump conduit means and said first conduit means communicates thereby with said third conduit means; said sump conduit means communicating said control valve means with said sump means; an improvement comprising:

check valve means in said second conduit means allowing fluid flow therethrough to said first end of said motor and normally blocking fluid flow therethrough from said first end of said motor to said control valve means;

hydraulically actuated means for opening said check valve means to allow fluid flow therethrough from said first end of said motor to said control valve means responsive to operation of said control valve means in said second position, said hydraulically actuated opening means comprising a pilot operated check valve; means biasing said pilot operated check valve to be closed; pilot conduit means communicating said third conduit means with said pilot operated check valve to provide fluid pressure from said fluid source means in opposition to said biasing means; drain conduit means communicating said first end of said hydraulic motor with said pilot operated check valve; pilot sump conduit means communicating said pilot operated check valve, when opened, with said sump means; float conduit means communicating said drain conduit means to said control valve; and drain path means in said control valve means which communicates said float conduit means to said sump means when said control valve means is in said float position; and wherein said drain path means comprises means within said control valve means for providing connection between said first conduit means and said second conduit means responsive to said control valve means being in said first position and between said first conduit means and said third conduit means responsive to said control valve means being in said second position while blocking said communication of said float conduit means with said sump means.

3. An improvement as in claim 2, including an in-line check valve in said float conduit means which allows fluid flow towards said control valve means and prevents fluid flow away therefrom.

4. An improvement as in claim 3, including:

pressure relief means communicating said first conduit means to said sump means when said control valve means is in said raise and lower positions.

5. An improvement as in claim 4, wherein said first and second ends of said hydraulic motor comprise respectively a head and rod end thereof.

6. An improvement as in claim 5, wherein said pilot operated check valve includes a piston within a bore in a pilot valve body, said pilot conduit means applies fluid pressure against a first area at a first end of said piston and said drain conduit means applies fluid pressure against a second area at a second end of said piston, a ratio of said first area to said second area is at least about 5:1, and said sump conduit means communicates with said bore adjacent said second end of said piston.

7. An improvement as in claim 6, wherein said piston comprises a first portion of a first cross-sectional area generally equal to said first area starting at said first end thereof and terminating intermediate said first and second ends thereof and a second portion of a second cross-sectional area generally equal to said second area starting at said second end thereof and terminating intermediate said first and second ends thereof and wherein said bore comprises a first bore portion in which said first piston portion reciprocally fits in sliding touching relation and a second bore portion in which said second piston portion reciprocally fits in spaced apart relation thereto and including: a seat in said valve body adjacent said second end of said piston and a member biased to sit against said seat and shut off said second bore portion, said member being forced away from said seat by said second end of said piston when said control valve means is in said lower position.

8. An improvement as in claim 3, wherein said check valve means comprises a sleeve-piston with a first end thereof closed and biased against a seat in a check valve body, said seat communicating with said second conduit means, said check valve means opening in said raise position to allow fluid flow therepast to said first end of said hydraulic motor via a continuation of said second conduit means, said sleeve-piston including a flow restricting hole latitudinally therethrough to a central bore thereof, said central bore communicating via said hole with said first end of said hydraulic motor in said lower and float positions and said check valve body including an egress communicating said central bore of said sleeve piston with said drain conduit means.

* * * * *